US005377788A

United States Patent [19]

Biewald et al.

[11] Patent Number: 5,377,788

[45] Date of Patent: Jan. 3, 1995

[54] SAFETY CATCH DEVICE FOR ELEVATORS

[75] Inventors: Joachim Biewald, Winnenden/Degenhof; Volker Scheub, Waiblingen; Helge Holler, Pforzheim; Karl Fenkl, Stuttgart; Stefan Hugel, Schwaikheim; Jörg Rothaupt, Schwäbisch Gmünd; Peter Schneider, Ditzingen; Wolfgang Barth, Bietigheim-Bissingen; Hermann Moll, Weissach im Tal; Horst Pollmann, Weil der Stadt, all of Germany

[73] Assignee: C. Haushahn GmbH & Co., Stuttgart, Germany

[21] Appl. No.: 100,615

[22] Filed: Jul. 30, 1993

[30] Foreign Application Priority Data

Aug. 8, 1992 [DE] Germany ..... 9210608

[51] Int. Cl.[6] ..... B66B 5/16

[52] U.S. Cl. ..... 187/374; 188/181 A

[58] Field of Search ..... 187/89, 90, 91, 80, 187/108, 106; 188/180, 181 A, 174, 175

[56] References Cited

U.S. PATENT DOCUMENTS 4,377,221 3/1983 Farr ..... 188/181 A

FOREIGN PATENT DOCUMENTS 0183616 6/1986 European Pat. Off. .
1205670 7/1980 Germany .
3934492 4/1990 Germany .
471270 8/1975 Russian Federation ..... 187/90
1359384 7/1974 United Kingdom .

*Primary Examiner*—Kenneth W. Noland
*Attorney, Agent, or Firm*—Friedrich Kueffner

[57] ABSTRACT

A safety catch device for elevator cars guided on at least one guide rail includes a braking device acting on the at least one guide rail for braking the elevator car and a control device for controlling the braking force of the braking device in dependence on the load and/or deceleration. The control device includes a control mass which is influenced by the acceleration of the elevator car and a brake spring which is deflected in accordance with the position of the control mass. The brake spring is coupled to the control mass and the braking device in such a way that a reduced braking force is applied by the braking device on the at least one guide rail in the case of a high deceleration of the elevator car and an increased braking force is applied by the braking device on the at least one guide rail in the case of a lower deceleration of the elevator car.

4 Claims, 3 Drawing Sheets

SAFETY CATCH DEVICE FOR ELEVATORS

BACKGROUND OF THE INVENTION

1. Field of the Invention

The present invention relates to a safety catch device for elevator cars guided on at least one guide rail. The safety catch device includes a braking device acting on the guide rail for braking the elevator car and a control device for controlling the braking force of the braking device in dependence on the load and/or deceleration.

2. Description of the Related Art

Safety catch devices used in elevators usually act independently of the load. The braking forces are applied by means of fixedly adjusted springs which apply the same forces on the rail in the case of an empty car as in the case of a full car after the cables have failed. This results in undesirably high decelerations when the elevator car is empty or contains only a small load.

In order to avoid the undesirably high decelerations or braking accelerations in the case of no load or a small load in the elevator car, it is necessary to control the braking forces in dependence on the load or deceleration.

DE-A-39 34 492 and EP-A-0 183 616 disclose controls for the application of braking forces of an elevator car in which the braking forces are controlled either hydraulically or electromagnetically. However, such controls require a complicated apparatus and may be susceptible to trouble.

SUMMARY OF THE INVENTION

Therefore, it is the primary object of the present invention to provide a safety catch device for elevators with a braking force control which is of simple construction, wherein the control device operates absolutely reliably and reacts immediately to any change of deceleration or change of braking acceleration.

In accordance with the present invention, the control device of the safety catch device includes a control mass which is influenced by the acceleration of the elevator car and a braking spring which is deflected in accordance with the position of the control mass, wherein the braking spring is coupled to the control mass and the braking device in such a way that a reduced braking force is applied by the braking device on the at least one guide rail in the case of a high deceleration of the elevator car and an increased braking force is applied by the braking device on the at least one guide rail in the case of a lower deceleration of the elevator car.

Thus, the control device provided in accordance with the present invention in the safety catch device operates solely mechanically and has a control mass influenced by the acceleration of the elevator car and a brake spring which is deflected in accordance with the position of the control mass, wherein the brake spring is coupled to the control mass and the braking device in the above-described manner.

This control device which operates solely mechanically does not have measuring sensors or regulating units as they are required in a hydraulic or electromagnetic control. In addition, the control device operates absolutely reliably and reacts immediately to any change of deceleration.

Since the control device according to the present invention is a proportional control device, it is desirable to keep the occurring control difference, i.e., a slight deceleration change, as small as possible.

For this purpose, in accordance with a preferred further development of the invention, the control mass is kept small and an adjusting gear unit for converting the movement of the control mass is provided between the control mass and the brake spring.

If two guide rails are provided, a synchronous behavior is achieved in an advantageous manner by constructing the control mass in the shape of a rod which simultaneously acts on two symmetrically constructed braking devices through two symmetrical adjusting gear units and two brake springs and through a swivel arm each.

Undesirably high load reductions of the brake spring and a cancellation of the elevator car deceleration resulting therefrom are prevented by stops mounted on the control device or, in accordance with an alternative feature, on the braking device.

In accordance with a preferred feature of the present invention, the braking device includes brake shoes which are pressed against the guide rails by means of brake wedges.

In accordance with another alternative feature, eccentrics or elbow levers can be used instead of the brake wedges. The adjusting gear unit preferably includes an adjusting thread which steps down the movement of the control mass transmitted through the swivel arms, as well as a lever which transmits an axial thread movement of the adjusting gear unit to the brake springs.

A safety catch procedure takes place as follows:

At a certain excess speed of the elevator car, the wedges of the safety catch device are retracted, so that a defined braking force is built up which decelerates the elevator car. Starting at a defined or adjustable deceleration, the control mass is moved downwardly by the deceleration. This movement is transmitted through the swivel arms, the adjusting gear unit and the brake spring to the brake wedges and reduces the braking forces until a certain ratio of braking force/control path has been adjusted and the elevator car is decelerated in a controlled manner independently of the load in the elevator car.

An alternative safety catch procedure operates as follows:

When a certain excess speed is reached, the brake wedges of the safety catch device are retracted, so that a defined braking force is built up. The control mass is in a deflected position already at the beginning of the safety catch procedure which means that the braking force is low. If the deceleration required for the adjustment of the control mass is not reached, the control mass is moved upwardly as a result of the control spring and thereby increases the braking force until a certain ratio of braking force/control path is reached.

In accordance with a preferred feature, a damping device acting on the lever is provided for damping or entirely preventing an undesirable oscillation of the control mass and, thus, an overswinging of the control device.

In accordance with a particularly preferred embodiment, the rod-shaped control mass is connected through a left and right swivel arm each to a left and right control gear unit, respectively, wherein the control gear units are opposed and each control gear unit has an attachment piece which carries out, corresponding to the swivel movement of the swivel arm, a linear movement extending axially relative to the swivel axis of the swivel arms. In this particularly preferred embodiment, two oppositely directed brake shoes act on each guide rail and each brake wedge can be actuated by an angle lever which is resiliently supported on the attachment piece of the control gear unit and on a center of spring rotation.

In accordance with a preferred feature, each center of spring rotation is formed by a torsion spring. The spring force acting on the angle lever in the center of spring rotation is adjustable. This can be effected in a particularly advantageous manner by forming each torsion spring of several torsion rods which are clamped so as to extend parallel to each other, wherein the spring force can be adjusted by selecting the appropriate number of torsion rods. This adjustability of the spring force makes it possible for the control device according to the present invention to be adapted to different weights of the elevator car without loads, or to average elevator car weights taking into consideration an average load.

In accordance with another preferred feature, the spring force in each center of spring rotation has an adjustable initial tension. The adjustability may advantageously be effected by adjusting the angular position of the torsion rods about the longitudinal axes thereof.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
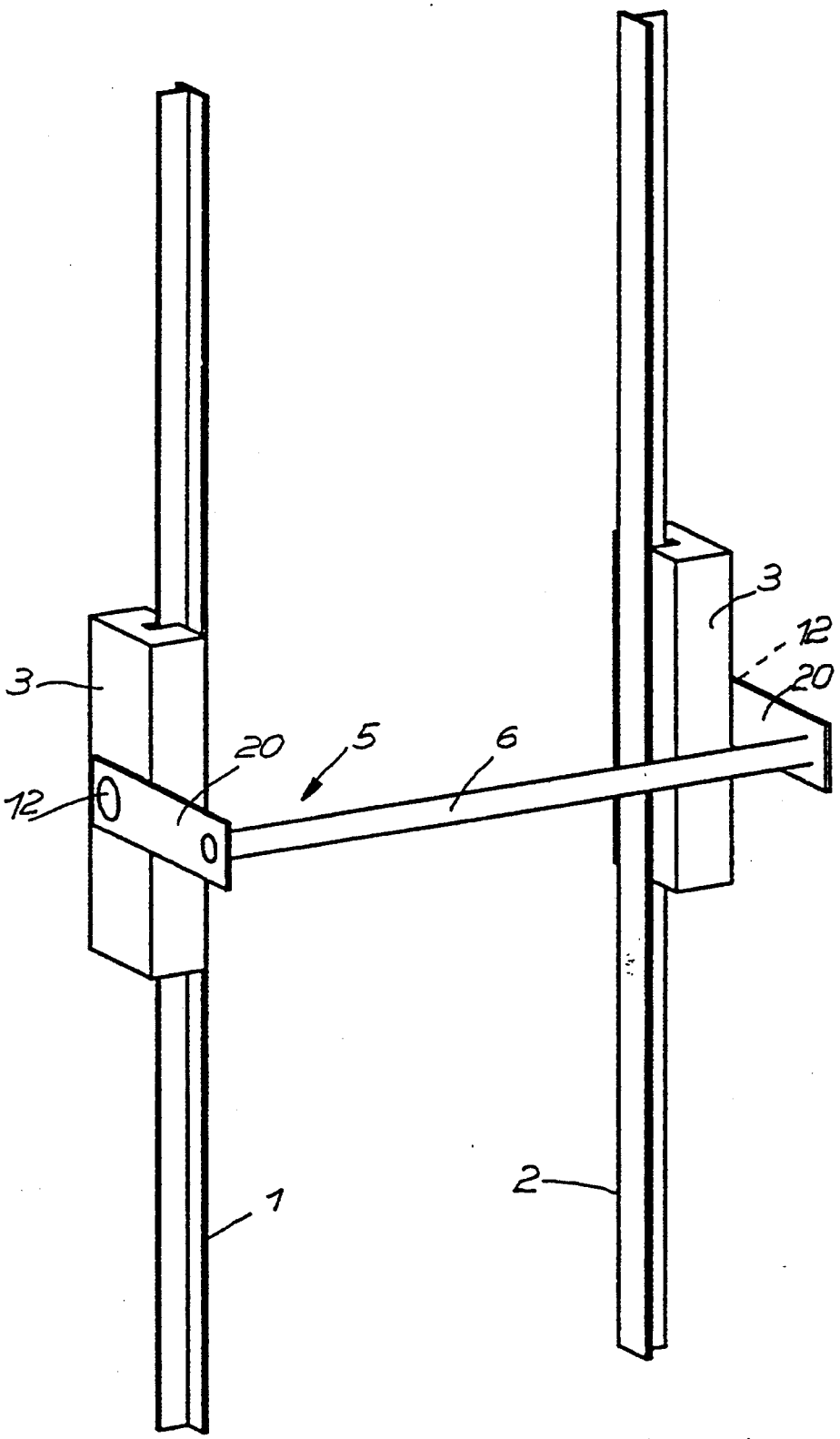
FIG. 1 is a schematic perspective view of a safety catch device according to the present invention with two guide rails.

As can be seen in the perspective view of FIG. 1, the illustrated safety catch device for elevators acts symmetrically on two parallel guide rails 1 and 2. A braking device 3 includes a left and right catch member each which is acted upon by a control device generally denoted by reference numeral 5. The control device 5 includes a rod-shaped control mass 6 which acts through two swivel arms 20 and a left and right adjusting gear unit 12 on the catch members of the braking device 3. The catch members are attached to an elevator car, not shown.

Figure 3:
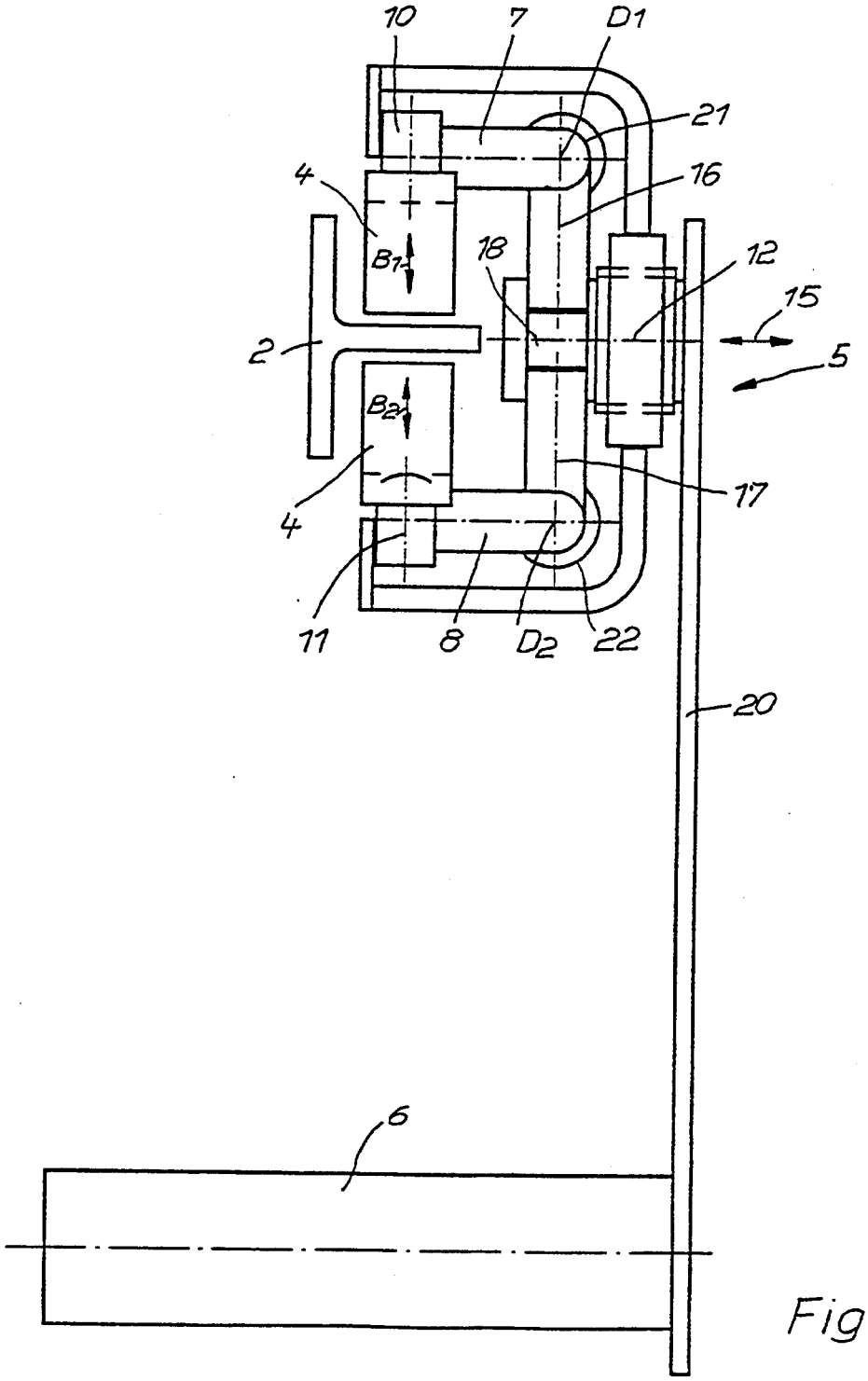
FIG. 3 is a top view, also on a larger scale, of a preferred embodiment of the safety catch device according to the present invention.

The safety catch device for elevators illustrated in FIG. 1 operates as follows:

The control mass 6 is moved upwardly or downwardly when a change of the braking acceleration occurs. As seen in FIG. 3, the movement of the control mass 6 is in a direction perpendicular to the plane of the drawing. The control mass 6 is moved along an arc-shaped path and the movement is transmitted through the swivel arms 20 to a threaded bolt rotatably arranged in the adjusting gear unit 12.

Figure 2:
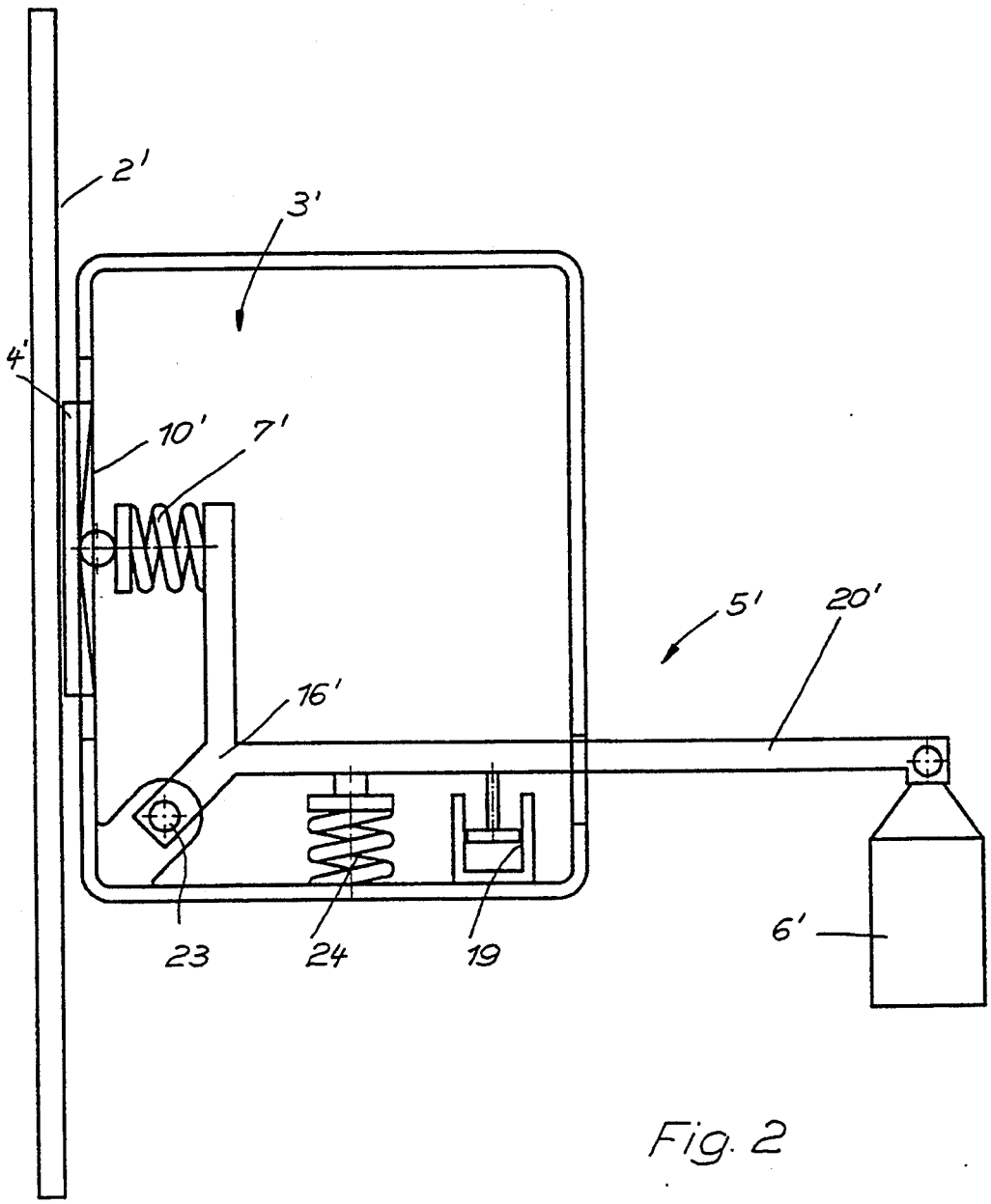
FIG. 2 is a schematic side view, on a larger scale, showing an embodiment of the safety catch device according to the present invention.

The operating principle of the safety catch device for elevators according to the present invention shall now be explained with the aid of FIG. 2 Through a swivel arm 20', which is integrally connected to a lever 16', a control mass 6' acts on a brake spring 7' accommodated within a housing and on a brake shoe 4' through the brake spring 7' and a brake wedge 10'. Starting at a defined braking deceleration in the case of downward travel of the elevator car, the control mass 6' is moved downwardly as a result of the deceleration and, through the unit composed of swivel arm 20', lever 16', brake spring 7' and wedge 10', the control mass 6' reduces the braking forces of the brake shoe 4' acting on a guide rail 2' until a certain ratio of braking force to control path is reached. As a result, the elevator car is decelerated in a controlled manner independently of the load in the elevator car. In FIG. 2, the brake spring 7' is a helical spring, while a torsion spring is used in the preferred embodiment of the safety catch device for elevators according to the present invention which is described below and shown in FIG. 3. The lever 16' is pivotally mounted within the safety catch device on a hinge point 23. Any overswinging of the control device is damped by a damping device 19. In the embodiment illustrated in FIG. 2, an additional counterspring 24 is provided which resiliently supports the lever 16' in its direction of movement opposite the brake spring 7'.

A preferred embodiment of the safety catch device for elevators according to the present invention shall now be described with the aid of FIG. 3. The unit illustrated in FIG. 3 corresponds to the unit shown on the right hand side in FIG. 1. A corresponding unit on the left is arranged symmetrically and is also connected to the control mass 6. The control mass 6 is coupled through the swivel arm 20 to an adjusting gear unit 12. A threaded bolt is arranged in the adjusting gear unit 12. The threaded bolt has an axial attachment piece 18 within a housing.

When the control mass 6 and the swivel arm 20 are moved into or out of the plane of the drawing of FIG. 3, the threaded bolt within the adjusting gear unit 12 carries out a movement in axial direction, as indicated by double arrow 15. Oppositely directed lever arms 16 and 17 are attached to the attachment piece 18. Each lever arm 16 and 17 is coupled through a center of spring rotation D1 or D2, respectively, to a second resilient lever arm 7, 8, respectively. The lever arms 7 and 16, on the one hand, and the lever arms 8 and 22, on the other hand, form portions of a torsion spring 21 and 22, respectively, which have the centers of spring rotation D1 and D2. In this manner, the movement of the attachment piece 18 of the threaded bolt in axial direction 15 at the ends 7 and 8 facing away from the centers of spring rotation D1 and D2 is converted through the brake wedges 10 and 11 into a linear movement of the brake shoes 4 in the direction of double arrows B1 and B2, so that the control device acts on the brake shoes and, thus, on the brake surfaces of the guide rail 2 in opposite directions.

A damping device 19 for damping overswinging of the control device and a counterspring corresponding to the counterspring 24 shown in FIG. 2 are not illustrated in FIG. 3. It is noted that the counterspring 24 must be provided for the proper operation of the safety catch device according to the present invention. The torsion springs 21 and 22 may be springs having any suitable shape, such as leaf springs or cylindrical springs.

The invention is not limited by the embodiments described above which are presented as examples only but can be modified in various ways within the scope of protection defined by the appended patent claims.

We claim:

1. A safety catch device for elevator cars guided on at least one guide rail, the safety catch device comprising a braking device for applying a braking force on the at least one guide rail for braking a downward movement of the elevator car, a control device for controlling the braking force of the braking device in dependence on at least one of load and deceleration, the control device comprising a control mass subjected to movement by acceleration of the elevator car and a brake spring mounted so as to be deflected in accordance with the position of the control mass and acting on the braking device, further comprising a swivably mounted two-sided lever having a first arm and a second arm, wherein the braking device and the control device are coupled through the two-sided lever, wherein the brake spring is configured to act on the first arm of the two-sided lever and the control mass is configured to act on the second arm of the two-sided lever, and wherein the brake spring is a compression spring, such that a deflection of the control mass during deceleration of the elevator car reduces the pressure acting on the brake spring.

2. The safety catch device according to claim 1, wherein the braking device comprises brake wedges and brake shoes connected to the brake wedges for acting on the at least one guide rail.

3. The safety catch device according to claim 1, comprising a damping device for acting on the two-sided lever for damping overswinging of the control mass.

4. The safety catch device according to claim 1, the brake spring being a coil spring supported at the two-sided lever and at the braking device.

* * * * *